US006872109B2

(12) United States Patent
Nagata et al.

(10) Patent No.: US 6,872,109 B2
(45) Date of Patent: Mar. 29, 2005

(54) FUEL TANK FOR PERSONAL WATERCRAFT

(75) Inventors: Tadaaki Nagata, Saitama (JP); Toshiaki Nakao, Saitama (JP); Yoshiaki Noda, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/282,015

(22) Filed: Oct. 29, 2002

(65) Prior Publication Data

US 2003/0129890 A1 Jul. 10, 2003

(30) Foreign Application Priority Data

Oct. 30, 2001 (JP) ..... 2001-333292

(51) Int. Cl.[7] ..... B63H 21/38
(52) U.S. Cl. ..... 440/88 F; 440/55.56
(58) Field of Search ..... 440/88 F

(56) References Cited

U.S. PATENT DOCUMENTS 4,836,835 A * 6/1989 Harris et al. ..... 96/113
5,839,489 A * 11/1998 Ganachaud et al. ..... 141/382
6,457,433 B1 * 10/2002 Nagata ..... 114/343

FOREIGN PATENT DOCUMENTS

JP 6-156366 A 6/1994

OTHER PUBLICATIONS

Patent Abstract of Japan JP06156366 A, Publication Date Jun. 3, 1994.

* cited by examiner

*Primary Examiner*—Jesus D. Sotelo
(74) *Attorney, Agent, or Firm*—Birch, Stewart, Kolasch & Birch, LLP

(57) ABSTRACT

A fuel tank for a personal watercraft of the type in which a main body portion of the fuel tank is disposed in a watercraft body. An oil supply port member of the fuel tank is provided at a deck constituting an upper portion of the watercraft body. The main body portion and the oil supply port member are connected to each other by a filler hose. The oil supply port member is closed with an oil supply cap. The oil supply port member includes a cylindrical passage provided with an oil supply port at one end thereof and with a hose connection portion at the other end thereof. A stopper for receiving the tip end of an oil supply nozzle is provided at an intermediate portion of the passage. The supply nozzle for re-supplying the fuel can be prevented from penetrating into the main body portion to a needlessly large extent. As a result, the main body portion of the fuel tank can be prevented from suffering scratches or the like.

26 Claims, 7 Drawing Sheets

FUEL TANK FOR PERSONAL WATERCRAFT

CROSS-REFERENCE TO RELATED APPLICATIONS

This nonprovisional application claims priority under 35 U.S.C. §119(a) on Patent Application No. 2001-333292 filed in Japan on Oct. 30, 2001, the entirety of which is hereby incorporated by reference.

BACKGROUND OF THE INVENTION

1. Field of the Invention

The present invention relates to a fuel tank for a personal watercraft of the type in which a main body portion of the fuel tank is disposed in a watercraft body. A deck constituting an upper portion of the watercraft body is provided with an oil supply port member of the fuel tank. The main body portion and the oil supply port member are connected to each other by a hose. Furthermore, the oil supply port member is closed with an oil supply cap.

2. Description of Related Art

A fuel tank for a personal watercraft has been disclosed in, for example, Japanese Patent Laid-open No. Hei 6-156366 entitled "PROPELLED WATERCRAFT."

According to FIGS. 1 and 6 in the above publication, the above-mentioned technology resides in that a propelled watercraft 10 for anchoring offshore to be utilized as a base for playing in the water or fishing and a jet propulsion watercraft 110 for pushing the propelled watercraft 10 for navigation are shown. The jet propulsion watercraft 110 is provided with a fuel tank 15. A mouthpiece 58 is fitted to the fuel tank 15. A cap 17 is fitted to the mouthpiece 58. The propelled watercraft 10 is provided with a fuel tank 5 for re-supply. Furthermore, fuel is re-supplied from the fuel tank 5 into the fuel tank 15 of the jet propulsion watercraft 110 through a fuel supply pump 52 and fuel take-out pipes 51, 56.

In the above-mentioned propelled watercraft; however, an oil supply nozzle may be inserted into the depth of the mouthpiece 58 of the fuel tank 15 at the time of re-supplying the fuel into the fuel tank 15 of the jet propulsion watercraft 110. In this case, it is necessary to use a material having high strength so that the inside of an oil supply pipe 16 (fuel re-supply pipe) and the fuel tank 15 do not suffer scratches or the like.

SUMMARY OF THE INVENTION

Accordingly, it is an object of the present invention to provide a technology which can prevent a nozzle on the supply side from penetrating into the inside of a fuel tank to a needlessly large extent at the time of re-supplying fuel into the fuel tank.

In order to attain the above object, a first aspect of the present invention is directed to a fuel tank for a personal watercraft of the type in which a main body portion of the fuel tank is disposed in a watercraft body. An oil supply port member of the fuel tank is provided at a deck constituting an upper portion of the watercraft body. The main body portion and the oil supply port member are connected to each other by a hose. The oil supply port member is closed with an oil supply cap. The oil supply port member includes a cylindrical passage provided with an oil supply port at one end thereof and is provided with a hose connection portion at the other end thereof. Furthermore, a stopper for positioning the tip end of an oil supply nozzle is provided at an intermediate portion of the passage.

In the above structure, the oil supply port member includes the cylindrical passage provided with the oil supply port at one end thereof and is provided with the hose connection portion at the other end thereof and the stopper for positioning the tip end of the oil supply nozzle for re-supplying fuel is provided at an intermediate portion of the passage. Accordingly, the supply nozzle is prevented from penetrating into the main body portion to a needlessly large extent. Therefore, the supply nozzle can be restrained from colliding against the inside wall of the hose or the main body portion of the fuel tank.

According to a second aspect of the present invention, the oil supply cap is provided with a chain for preventing the oil supply cap from dropping into the water. Furthermore, one end of the chain is connected to the oil supply port member at a position below the stopper.

With the one end of the chain connected to the oil supply port member at a position below the stopper, the oil supply nozzle does not collide with the one end of the chain at the time of supplying the fuel. As a result, it is possible to obviate the interference of the oil supply nozzle with the portion of the oil supply port member to which the one end of the chain is connected.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
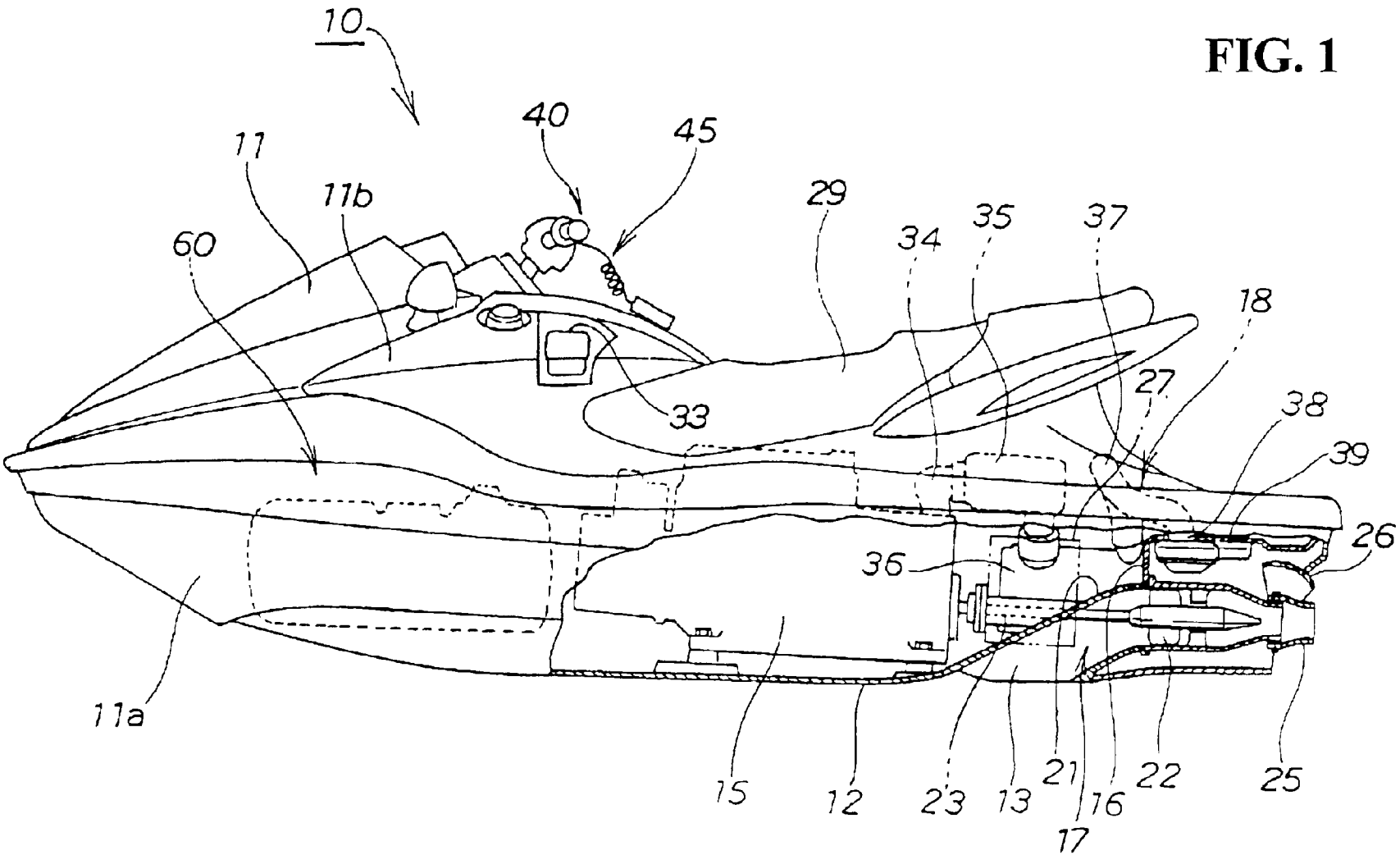
FIG. 1 is a side view of a personal watercraft on which a fuel tank according to the present invention is mounted.

An embodiment of the present invention will be described below based on the accompanying drawings. The drawings should be viewed in accordance with the orientation of the reference numerals.

FIG. 1 is a side view of a personal watercraft on which a fuel tank according to the present invention is mounted. The personal watercraft 10 includes the fuel tank 60 fitted to a front portion 11*a* of a watercraft body 11. An engine 15 is provided on the rear side of the fuel tank 60. A pump chamber 16 is provided on the rear side of the engine 15. A jet propeller 17 is provided in the pump chamber 16. An exhaust unit 18 includes an intake side fitted to the engine 15 and an exhaust side fitted to the pump chamber 16. A steering device 40 is fitted on the upper side of the fuel tank 14. Furthermore, a seat 29 is fitted on the rear side of the steering device 40.

The jet propeller 17 includes a housing 21 extending rearwards from an opening 13 formed in a watercraft bottom 12. An impeller 22 is rotatably fitted in the housing 21. Furthermore, the impeller 22 is connected to a drive shaft 23 of the engine 15.

According to the jet propeller 17, with the engine 15 driven to rotate the impeller 22, water sucked in through the opening 13 at the watercraft bottom 12 can be jetted to the rear side of the watercraft body 11 from a steering pipe 25 through a rear end opening of the housing 21. The steering pipe 25 is a member fitted to the rear end of the housing 21 so that it can be swung to left and right directions, and is a steering nozzle for controlling the steering direction of the watercraft body 11 by being swung to the left and right directions by operating the steering device 40.

Specifically, the personal watercraft 10 is a jet propulsion watercraft in which fuel is supplied from the fuel tank 14 to the engine 15 to drive the engine 15. A driving force of the engine 15 is transmitted to the impeller 22 through the drive shaft 23, to rotate the impeller 22. Accordingly, water is sucked in through the opening 13 at the watercraft bottom 12. The water thus sucked in is jetted from the steering pipe 25 through the rear end of the housing 21, whereby the watercraft is propelled.

In the figure, reference numeral 11*b* identifies a deck constituting an upper portion of the watercraft body 11. Reference numeral 26 identifies a reverse bucket set to cover the steering pipe 25 to direct a jet water flow to a skewed forwardly downward direction at the time of moving the watercraft backwards. Reference numeral 27 identifies a battery which is a power source for the watercraft body 11. Reference numeral 33 identifies an operating knob for operating the reverse bucket 26. Reference numeral 34 identifies an exhaust pipe. Reference numeral 35 identifies an exhaust body. Reference numeral 36 identifies a water muffler. Reference numeral 37 identifies a water lock pipe. Reference numeral 38 identifies a tail pipe. Reference numeral 39 identifies a resonator.

Figure 2:
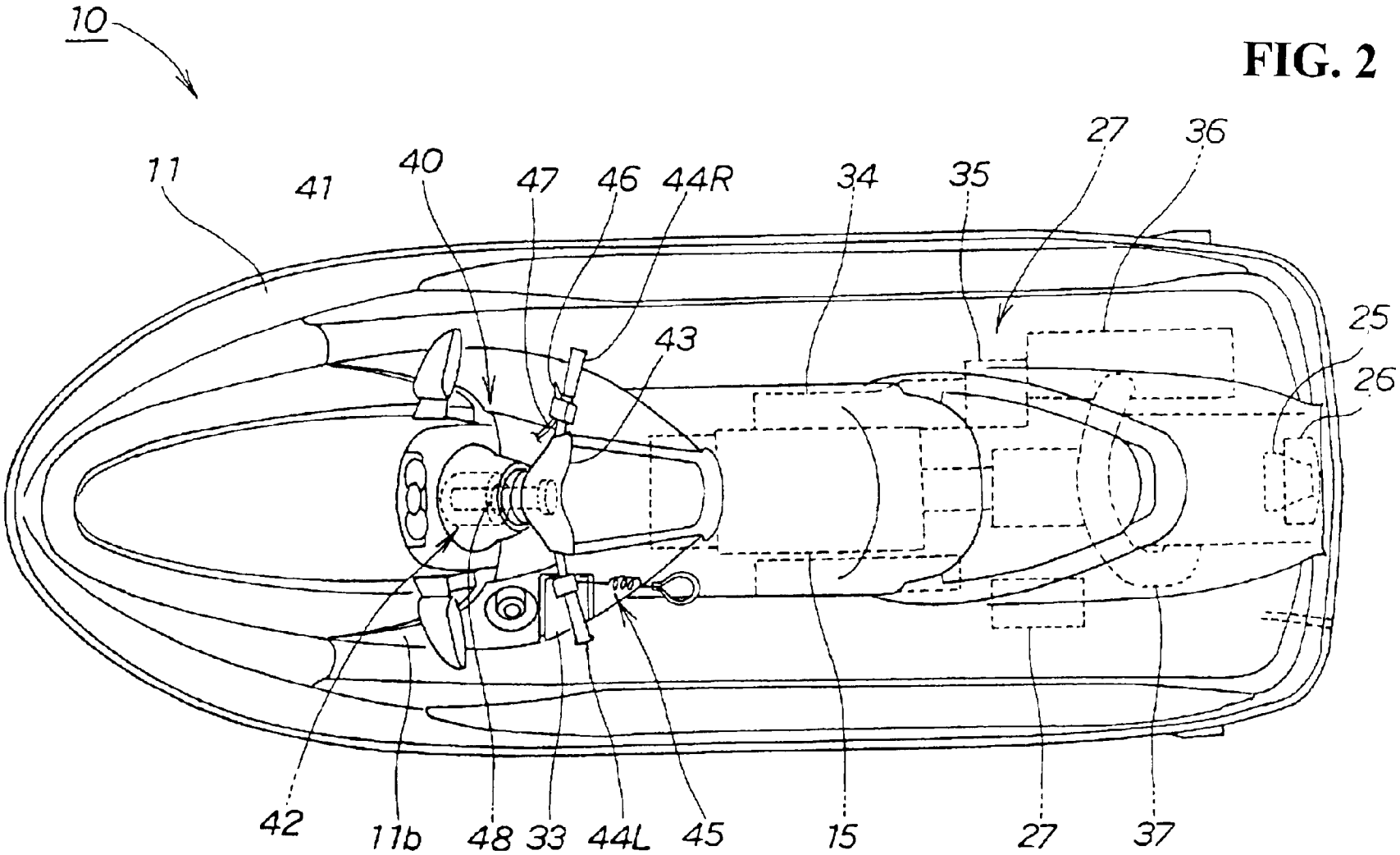
FIG. 2 is a plan view of the personal watercraft on which the fuel tank according to the present invention is mounted.

FIG. 2 is a plan view of the personal watercraft on which the fuel tank according to the present invention is mounted. The steering device 40 includes a steering shaft 41 rotatably fitted to the watercraft body 11. A handle holder 42 is rotatably fitted to the steering shaft 41. A handle 43 is fitted to the upper end of the steering shaft 41. Left and right handle grips 44L and 44R are fitted to left and right end portions of the handle 43. A main switch 45 is provided with a lanyard switch provided at a base portion of the left handle grip 44L. A throttle lever 46 is swingably fitted to a base portion of the right handle grip 44R. A throttle cable 47 extends from the throttle lever 46 to a throttle. Furthermore, a holding member 48 is provided for supporting the steering shaft 41 and holding the steering shaft 41 on the handle holder 42.

Figure 3:
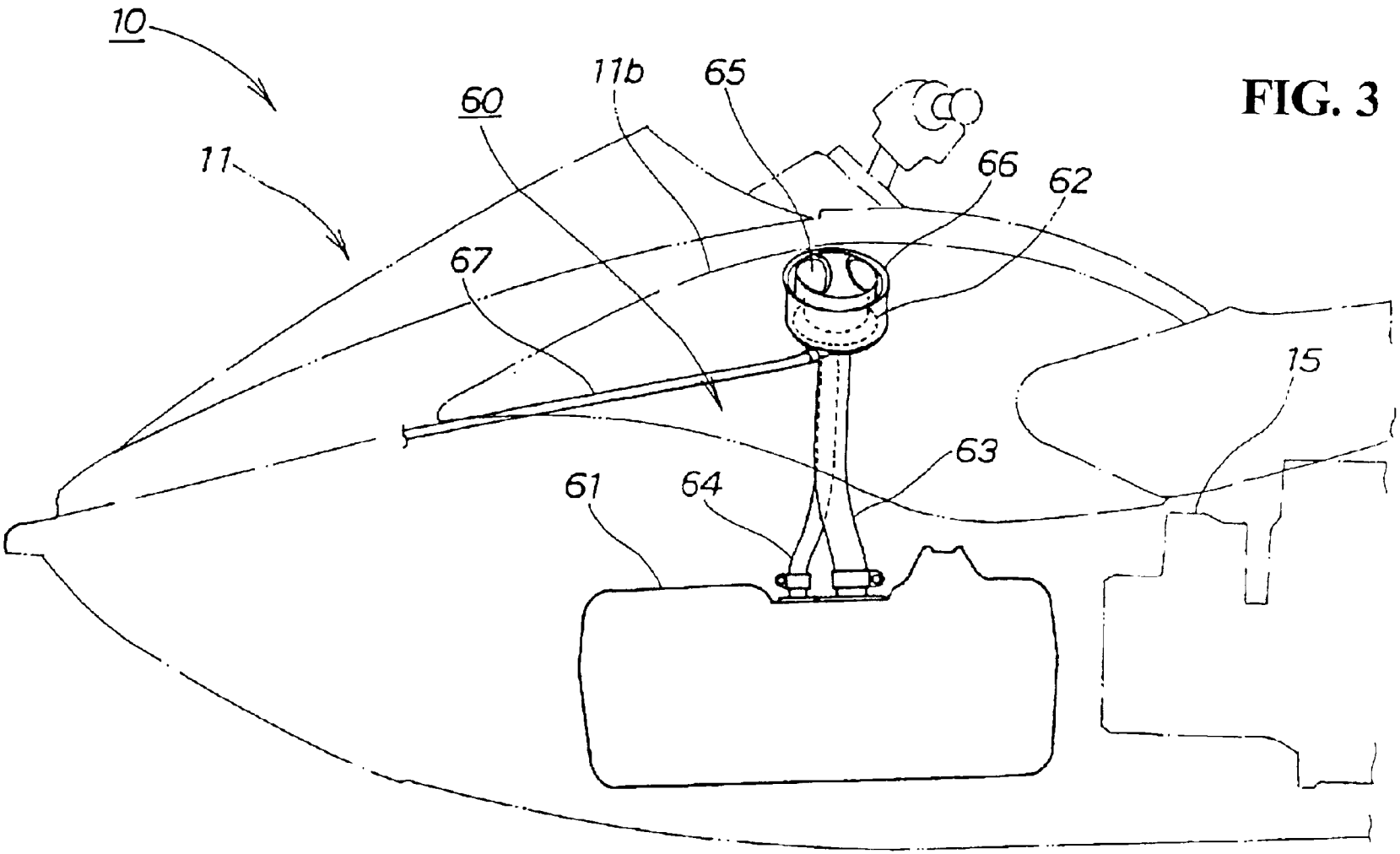
FIG. 3 is a side view of the fuel tank for the personal watercraft according to the present invention.

FIG. 3 is a side view of the fuel tank for the personal watercraft according to the present invention. The fuel tank 60 for the personal watercraft (hereinafter referred to simply as "fuel tank 60") includes a main body portion 61 for reserving fuel. An oil supply port member 62 for supplying fuel is fitted to the deck 11*b* constituting an upper portion of the watercraft body 11. A filler hose 63 is provided as a fuel supply hose for connecting the main body portion 61 and the oil supply port member 62 to each other. A breathing hose 64 is provided for maintaining the tank pressure in the main body portion 61 at a constant value. An oil supply cap 65 is provided for closing the oil supply port member 62. A cup 66 is provided for covering the oil supply cap 65 and the oil supply port member 62 collectively. A water drain hose 67 is provided for draining water from the bottom of the cup 66. Furthermore, a chain 68 (See FIG. 5) is provided for connecting the oil supply port member 62 and the oil supply cap 65 to each other so as to prevent the oil supply cap 65 from dropping into the water.

Figure 4:
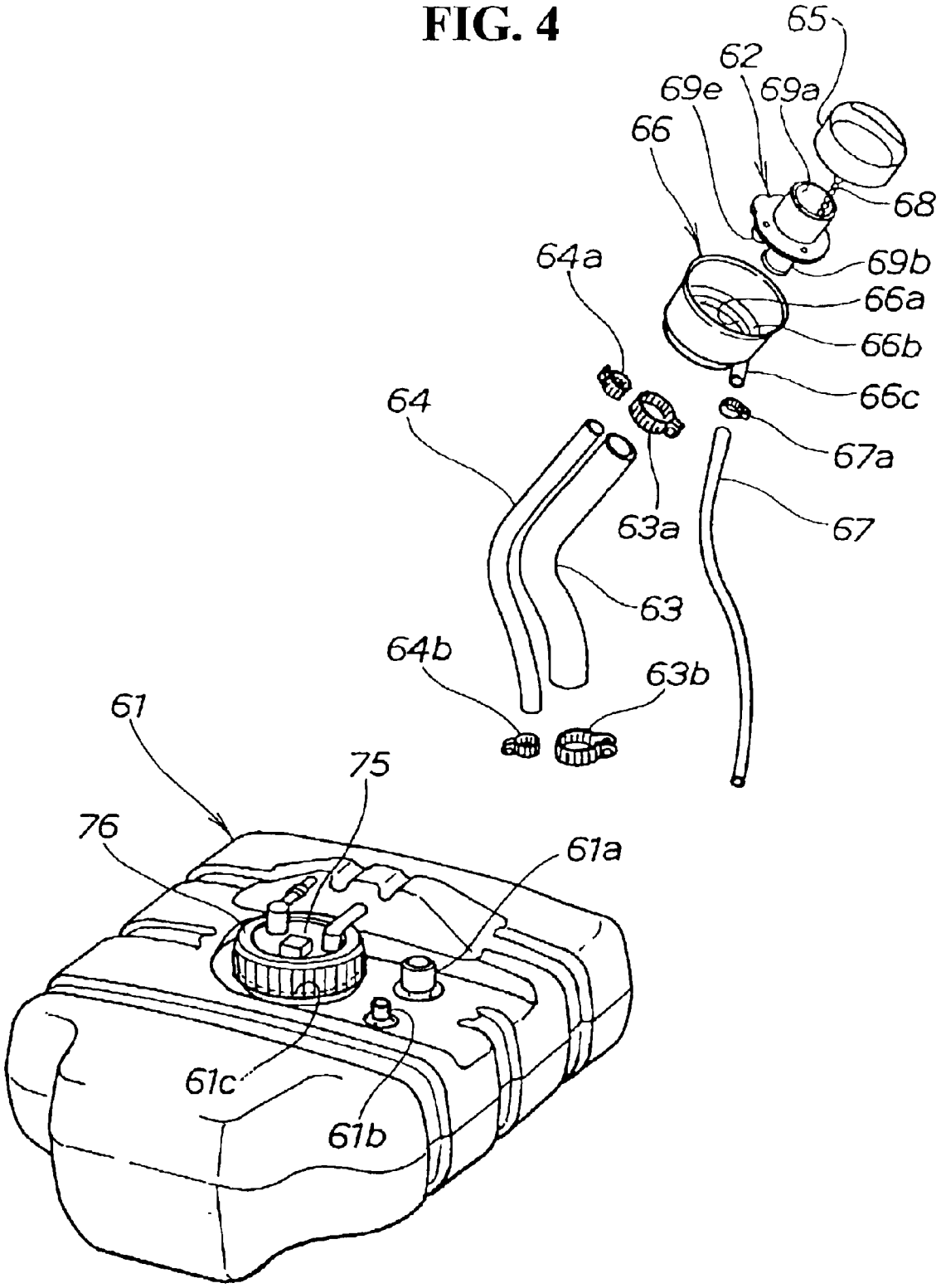
FIG. 4 is an exploded perspective view of the fuel tank for the personal watercraft according to the present invention.

FIG. 4 is an exploded perspective view of the fuel tank for the personal watercraft according to the present invention, and shows major component parts of the fuel tank 60. The main body portion 61 is a made from a resin or resin-like material and includes a first connection port 61*a* for connecting the fuel supply filler hose 63 thereto, a second connection port 61*b* for connecting the breathing hose 64 thereto, a fuel pump 75 inserted into an opening 61*c*, and a fixing ring 76 for fixing the fuel pump 75.

The fuel supply filler hose 63 includes a hose band 63*a* for fixing one end of the filler hose 63 to the oil supply port member 62, and a hose band 63*b* for fixing the other end of the filler hose 63 to the first connection port 61*a*. The breathing hose 64 includes a hose band 64*a* for fixing one end of the breathing hose 64 to the oil supply port member 62, and a hose band 64*b* for fixing the other end of the breathing hose 64 to the second connection port 61*b*.

The cup 66 is provided with an opening portion 66*a* penetrating through a lower portion of the oil supply port member 62. A flange portion 66*b* is provided for fastening to the deck 11*b* (See FIG. 1) together with the oil supply port member 62. Furthermore, a water drain port 66*c* is provided in the cup 66 for draining water.

The water drain hose 67 is provided with a hose band 67*a* for fixing the water drain hose 67 to the water drain port 66*c*.

Figure 5:
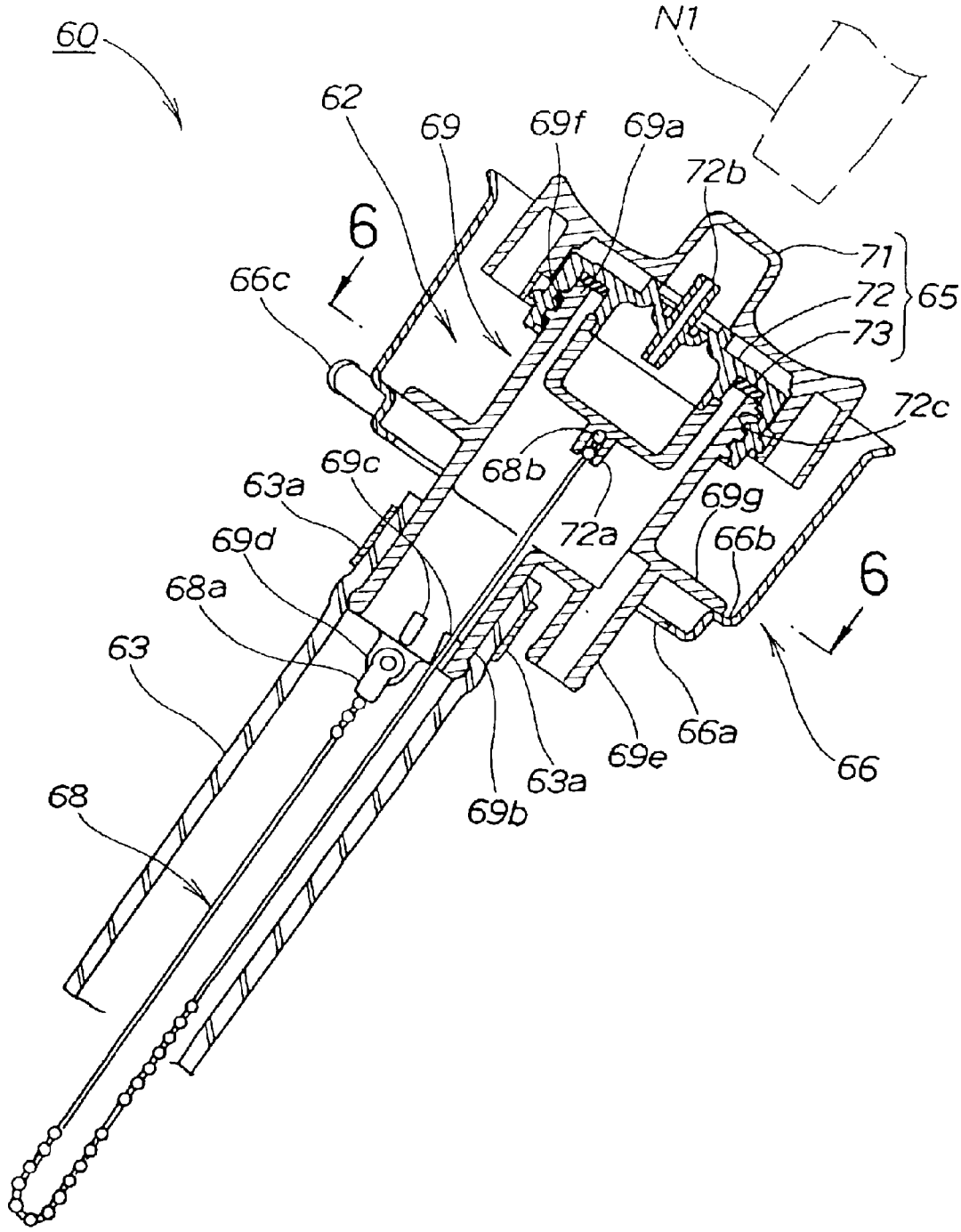
FIG. 5 is a front sectional view of the fuel tank for the personal watercraft according to the present invention.

FIG. 5 is a front sectional view of the fuel tank for the personal watercraft according to the present invention. The oil supply port member 62 includes a cylindrical passage 69 provided with an oil supply port 69*a* for fitting the oil supply cap 65 at one end thereof. A hose connection portion 69*b* is provided for connecting the fuel supply filler hose 63 at the other end thereof. The passage 69 is provided with stoppers 69*c* formed at intermediate portions of the passage 69 for positioning the tip end of an oil supply nozzle N1. A stopping portion 69*d* is formed on the lower side of the stoppers 69*c* for stopping one end 68*a* of the chain 68. A breathing hose connection portion 69*e* is branched from a middle portion of the passage 69 for connecting the breathing hose 64. A male screw portion 69*f* is provided for screw-connecting into the oil supply cap 65. Furthermore, a flange portion 69*g* is provided for fastened to the deck 11*b* (See FIG. 1) of the watercraft body 11 together with the cup 66 and the oil supply port member 62.

The oil supply cap 65 includes an outer cap 71, an inner cap 72 formed as one body with the outer cap 71, and a packing 73 fitted to the inner cap 72. The inner cap 72 includes a fitting portion 72*a* for fitting the other end 68*b* of the chain 68. A breathing hole 72*b* is provided for maintaining the pressure inside the main body portion 61 at atmospheric pressure. Furthermore, a female screw portion 72*c* is provided for screw-connecting to the oil support port 69*a*.

The fuel tank 60 is a member in which the oil supply cap 65 is provided with the chain 68 for preventing the oil supply cap 65 from dropping into the water. The one end 68*a* of the chain 68 is connected to the oil supply port member 69 at a position below the stoppers 69*c*.

Since the one end 68*a* of the chain 68 is connected to the oil supply port member 69 at a position below the stoppers 69*c*, there is no risk of the oil supply nozzle N1 colliding with the one end of the chain 68*a* at the time of supplying the oil. As a result, interference of the oil supply nozzle N1 with the portion (stopping portion 69*d*) of the oil supply port member 62 to which one end of the chain is connected can be obviated.

Specifically, the fuel tank 60 is a fuel tank for a personal watercraft of the type in which the main body portion 61 of the fuel tank 60 is disposed in the watercraft body 11 shown in FIG. 1. The oil supply port member 62 of the fuel tank 60 is provided at the deck 11*b* constituting an upper portion of the watercraft body 11. The main body portion 61 and the oil supply port member 62 are connected to each other by the filler hose 63. Furthermore, the oil supply port member 62 is closed with the oil supply cap 65. The oil supply port member 62 includes the cylindrical passage 69 provided with the oil supply port 69*a* at one end thereof and with the hose connection portion 69*b* at the other end thereof. The stoppers 69*c* for positioning the tip end of the oil supply nozzle N1 are provided at intermediate portions of the passage 69.

Figure 6:
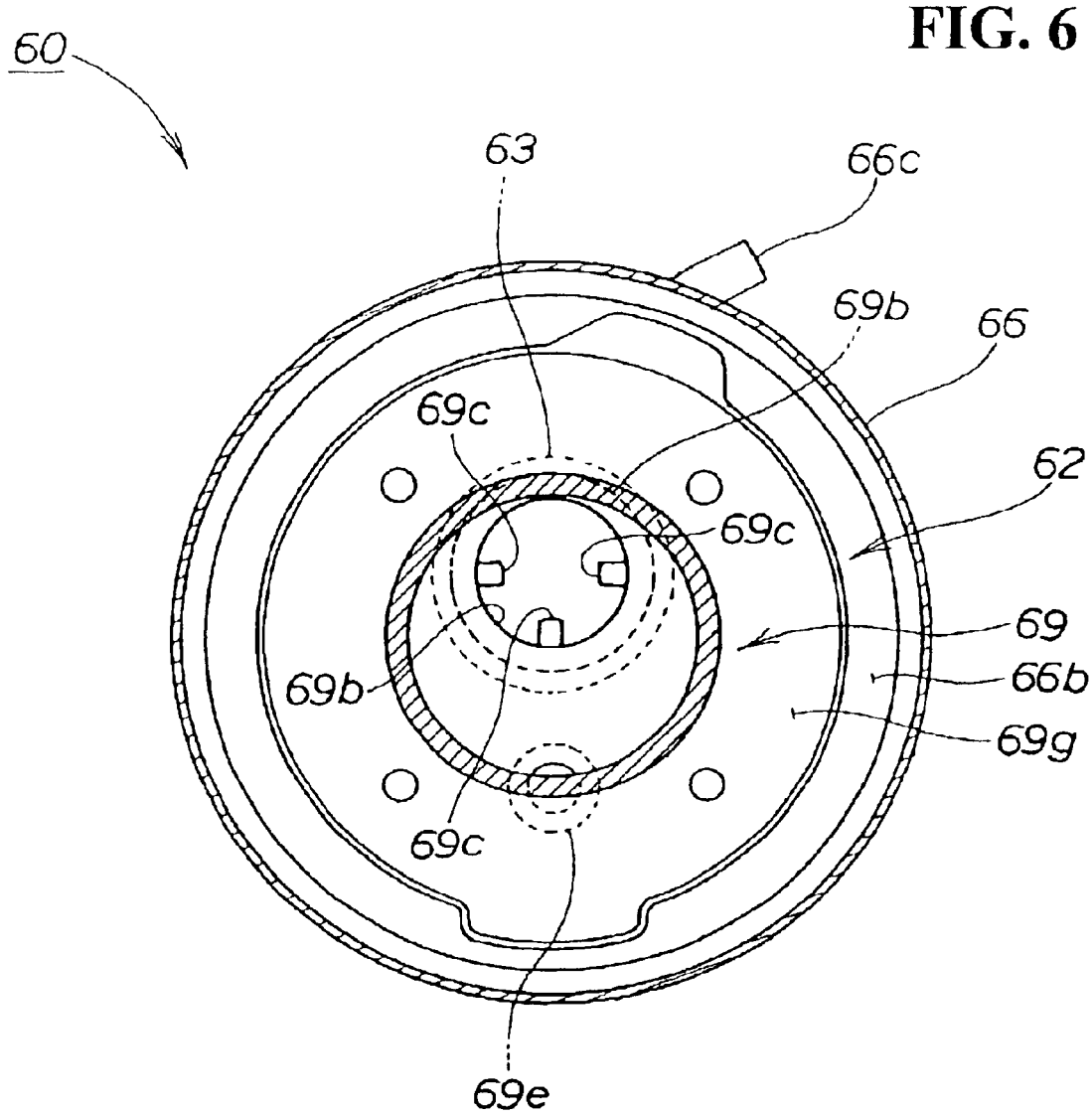
FIG. 6 is a sectional view taken along line 6—6 of FIG. 5.

FIG. 6 is a sectional view taken along line 6—6 of FIG. 5, and is a plan sectional view of the fuel tank 60. The fuel tank 60 has the oil supply port member 62, which includes the cylindrical passage 69 provided with the oil supply port 69*a* (See FIG. 5) at one end thereof and with the hose connection portion 69*b* at the other end thereof. The stoppers 69*c* for positioning the tip end of the oil supply nozzle N1 (See FIG. 5) for re-supplying the fuel are provided at intermediate portions of the passage 69. Accordingly, it is possible to prevent the oil supply nozzle N1 from penetrating into the filler hose 63 or into the main body portion 61 (See FIG. 4) to a needlessly large extent.

As a result, it is possible to obviate the collision of the supply nozzle N1 with the filler hose 63 or the main body portion 61 of the fuel tank 60. In addition, the stoppers 69*c* are shown to be three projections projected from the passage 69. However, it should be understood that less or more stoppers are within the scope of the present invention.

Figures 7A, 7B, 7C:
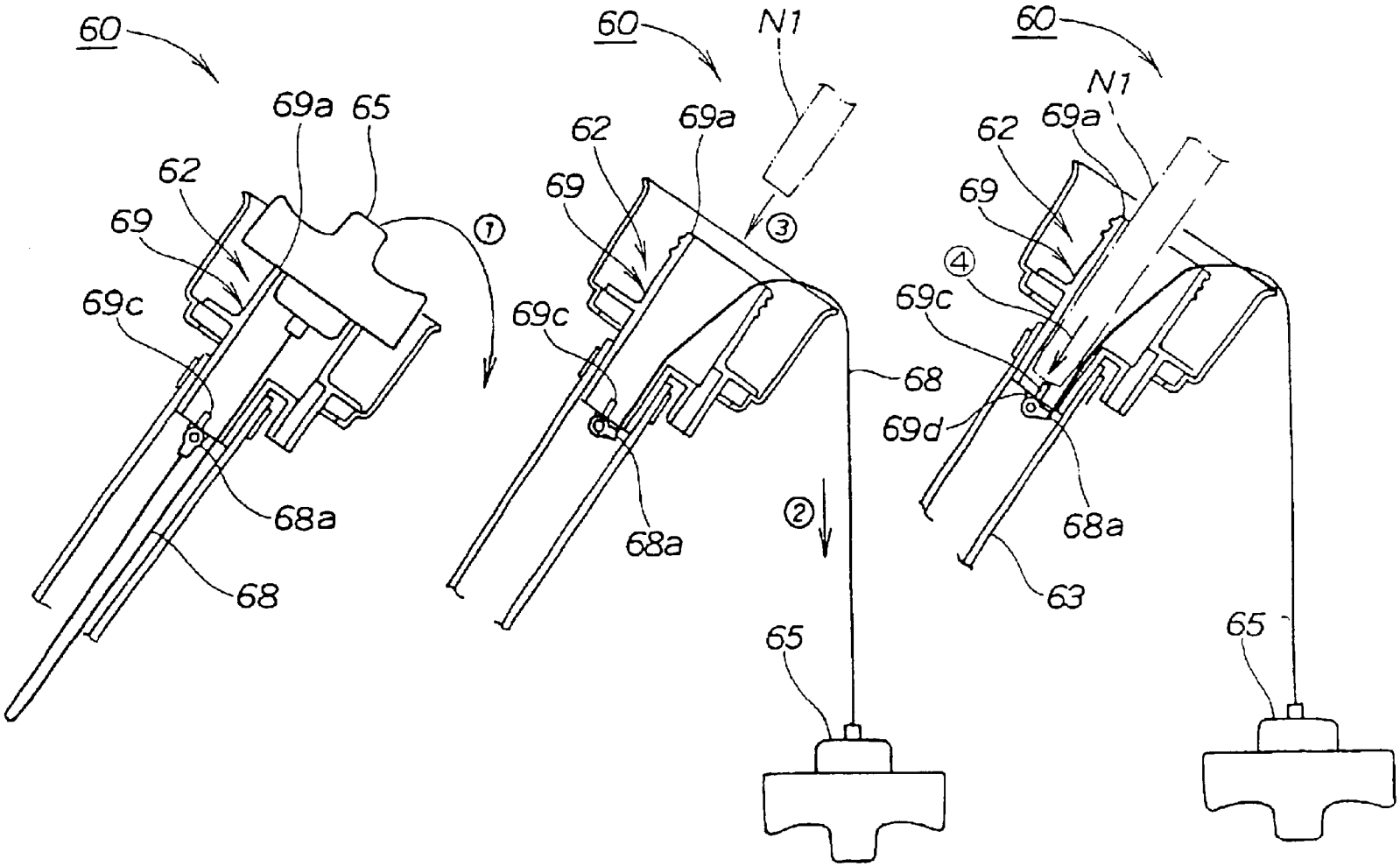
FIGS. 7(*a*) to 7(*c*) are action illustrations of the fuel tank for the personal watercraft according to the present invention.

Actions of the fuel tank 60 as described above will now be described. FIGS. 7(*a*) to 7(*c*) are action illustrations of the fuel tank for the personal watercraft according to the present invention.

In FIG. 7(*a*), the oil supply cap 65 is detached from the oil supply port 69*a* as indicated by arrow ①.

In FIG. 7(*b*), the oil supply cap 65 can be hung by the chain 68 as indicated by arrow ②, so that there is no fear of the oil supply cap 65 dropping into the water. Thereafter, the oil supply nozzle N1 is inserted into the oil supply port 69*a* as indicated by arrow ③.

In FIG. 7(*c*), the tip end of the oil supply nozzle N1 comes into contact with the stopper 69*a* of the passage 69 as indicated by arrow ④. Specifically, the oil supply nozzle N1 (See FIG. 5) can be prevented from penetrating into the filler hose 63 or into the main body portion 61 (See FIG. 4) to a needlessly large extent.

In addition, the one end 68*a* of the chain 68 is connected to the oil supply port member 69 at a position below the stoppers 69*c*. Accordingly, the oil supply nozzle N1 does not collide with the one end 68*a* of the chain 68 at the time of supplying the oil. As a result, interference of the oil supply nozzle N1 with the portion (stopping portion 69*d*) of the oil supply port member 69 to which one end of the chain 68 is connected can be obviated.

While the stoppers 69*c* are three projections projected from the passage 69 as shown in FIG. 6 in the above embodiment, this structure is not limitative. Specifically, the number or shape of the projections are arbitrary. For example, the stoppers may be pins or rods bridging across the diameter of the passage.

The present invention, constituted as described above, displays the following effects.

According to the first aspect of the present invention, the oil supply port member includes the cylindrical passage provided with the oil supply port at one end thereof and with the hose connection portion at the other end thereof. The stopper for positioning the tip end of the oil supply nozzle is provided at an intermediate portion of the passage. Therefore, the supply nozzle for re-supplying the fuel can be prevented from penetrating into the main body portion to a needlessly large extent. As a result, the supply nozzle can be prevented from colliding with the main body portion of the fuel tank.

According to the second aspect of the present invention, the oil supply cap is provided with the chain for preventing the oil supply cap from dropping into the water. One end of the chain is connected to the oil supply port member at a position below the stopper. Therefore, the oil supply nozzle does not collide with the one end of the chain at the time of supplying the oil. As a result, interference of the supply nozzle with the portion of the oil supply port member to which the one end of the chain is connected can be obviated.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A fuel tank for a personal watercraft, comprising:

a main body portion, said main body portion being mountable in a watercraft body;

an oil supply port member, said oil supply port member being mountable at a deck constituting an upper portion of the watercraft body, said main body portion and said oil supply port member being connected to each other by at least one hose, said oil supply port member including:

a cylindrical passage provided with an oil supply port at one end thereof and at least one hose connection portion at the other end thereof for receiving said hose, said cylindrical passage having a wall with an inside surface extending generally parallel to an axis of said cylindrical passage; and a stopper for receiving a tip end of an oil supply nozzle, said stopper being provided at an intermediate portion of said cylindrical passage and extending inwardly from said surface of said wall; and an oil supply cap, said oil supply port member being closed with said oil supply cap.

2. The fuel tank for a personal watercraft according to claim 1, wherein said oil supply cap is provided with a chain for preventing said oil supply cap from dropping into the water, one end of said chain is connected to said oil supply port member at a position below said stopper.

3. The fuel tank for a personal watercraft according to claim 2, wherein said one end of said chain is connected to a bottom of said cylindrical passage below said stopper.

4. The fuel tank for a personal watercraft according to claim 2, further comprising a cup for covering said oil supply cap and said oil supply port member collectively.

5. The fuel tank for a personal watercraft according to claim 2, wherein said cylindrical passage of said oil supply port member includes two of said at least one hose connection portion, a first hose connection portion is connected to a first connection port of said main body portion by a first of said at least one hose, and a second hose connection portion is connected to a second connection port of said main body portion by a second of said at least one hose.

6. The fuel tank for a personal watercraft according to claim 7, wherein said first hose is a filler hose provided as a fuel supply hose for connecting said main body portion and said oil supply port member to each other, said second hose is a breathing hose provided for maintaining pressure in said main body portion at a constant value.

7. The fuel tank for a personal watercraft according to claim 1, further comprising a cup for covering said oil supply cap and said oil supply port member collectively.

8. The fuel tank for a personal watercraft according to claim 1, wherein said cylindrical passage of said oil supply port member includes two of said at least one hose connection portion, a first hose connection portion is connected to a first connection port of said main body portion by a first of said at least one hose, and a second hose connection portion is connected to a second connection port of said main body portion by a second of said at least one hose.

9. The fuel tank for a personal watercraft according to claim 8, wherein said first hose is a filler hose provided as a fuel supply hose for connecting said main body portion and said oil supply port member to each other, said second hose is a breathing hose provided for maintaining pressure in said main body portion at a constant value.

10. A fuel tank, comprising:

a main body portion;

an oil supply port member, said main body portion and said oil supply port member being connected to each other by at least one hose, said oil supply port member including:

a cylindrical passage provided with an oil supply port at one end thereof and at least one hose connection portion at the other end thereof for receiving said hose, said cylindrical passage having a wall with an inside surface extending generally parallel to an axis of said cylindrical passage; and a stopper for receiving a tip end of an oil supply nozzle, said stopper being provided at an intermediate portion of said cylindrical passage and extending inwardly from said surface of said wall; and an oil supply cap, said oil supply port member being closed with said oil supply cap.

11. The fuel tank according to claim 10, wherein said oil supply cap is provided with a chain for preventing said oil supply cap from dropping, one end of said chain is connected to said oil supply port member at a position below said stopper.

12. The fuel tank according to claim 11, wherein said one end of said chain is connected to a bottom of said cylindrical passage below said stopper.

13. The fuel tank according to claim 11, further comprising a cup for covering said oil supply cap and said oil supply port member collectively.

14. The fuel tank according to claim 11, wherein said cylindrical passage of said oil supply port member includes two of said at least one hose connection portion, a first hose connection portion is connected to a first connection port of said main body portion by a first of said at least one hose, and a second hose connection portion is connected to a second connection port of said main body portion by a second of said at least one hose.

15. The fuel tank according to claim 10, further comprising a cup for covering said oil supply cap and said oil supply port member collectively.

16. The fuel tank according to claim 14, wherein said first hose is a filler hose provided as a fuel supply hose for connecting said main body portion and said oil supply port member to each other, said second hose is a breathing hose provided for maintaining pressure in said main body portion at a constant value.

17. The fuel tank according to claim 10, wherein said cylindrical passage of said oil supply port member includes two of said at least one hose connection portion, a first hose connection portion is connected to a first connection port of said main body portion by a first of said at least one hose, and a second hose connection portion is connected to a second connection port of said main body portion by a second of said at least one hose.

18. The fuel tank according to claim 17, wherein said first hose is a filler hose provided as a fuel supply hose for connecting said main body portion and said oil supply port member to each other, said second hose is a breathing hose provided for maintaining pressure in said main body portion at a constant value.

19. A fuel tank, comprising:

a main body portion;

an oil supply port member, said main body portion and said oil supply port member being connected to each other by at least one hose, said oil supply port member including:

a cylindrical passage provided with an oil supply port at one end thereof and at least one hose connection portion at the other end thereof for receiving said hose; and a stopper for receiving a tip end of an oil supply nozzle, said stopper being provided at an intermediate portion of said cylindrical passage; and an oil supply cap, said oil supply port member being closed with said oil supply cap, wherein said oil supply cap is provided with a chain for preventing said oil supply cap from dropping, one end of said chain is connected to said oil supply port member at a position below said stopper.

20. The fuel tank according to claim 19, wherein said one end of said chain is connected to a bottom of said cylindrical passage below said stopper.

21. The fuel tank according to claim 19, further comprising a cup for covering said oil supply cap and said oil supply port member collectively.

22. The fuel tank according to claim 19, wherein said cylindrical passage of said oil supply port member includes two of said at least one hose connection portion, a first hose connection portion is connected to a first connection port of said main body portion by a first of said at least one hose, and a second hose connection portion is connected to a second connection port of said main body portion by a second of said at least one hose.

23. The fuel tank according to claim 22, wherein said first hose is a filler hose provided as a fuel supply hose for connecting said main body portion and said oil supply port member to each other, said second hose is a breathing hose provided for maintaining pressure in said main body portion at a constant value.

24. A fuel tank, comprising:

a main body portion;

an oil supply port member, said main body portion and said oil supply port member being connected to each other by at least one hose, said oil supply port member including:

a cylindrical passage provided with an oil supply port at one end thereof and at least one hose connection portion at the other end thereof for receiving said hose; and a stopper for receiving a tip end of an oil supply nozzle, said stopper being provided at an intermediate portion of said cylindrical passage;

an oil supply cap, said oil supply port member being closed with said oil supply cap; and a cup for covering said oil supply cap and said oil supply port member collectively.

25. A fuel tank, comprising:

a main body portion;

an oil supply port member, said main body portion and said oil supply port member being connected to each other by at least one hose, said oil supply port member including:

a cylindrical passage provided with an oil supply port at one end thereof and at least one hose, said cylindrical passage having a wall with an inside surface extending generally parallel to an axis of said cylindrical passage connection portion at the other end thereof for receiving said hose; and a stopper for receiving a tip end of an oil supply nozzle, said stopper being provided at an intermediate portion of said cylindrical passage; and an oil supply cap, said oil supply port member being closed with said oil supply cap, wherein said cylindrical passage of said oil supply port member includes two of said at least one hose connection portion, a first hose connection portion is connected to a first connection port of said main body portion by a first of said at least one hose, and a second hose connection portion is connected to a second connection port of said main body portion by a second of said at least one hose.

26. The fuel tank according to claim 25, wherein said first hose is a filler hose provided as a fuel supply hose for connecting said main body portion and said oil supply port member to each other, said second hose is a breathing hose provided for maintaining pressure in said main body portion at a constant value.

* * * * *